US009622594B2

(12) United States Patent
Gommermann et al.

(10) Patent No.: US 9,622,594 B2
(45) Date of Patent: Apr. 18, 2017

(54) PRODUCT DISPLAY UNIT WITH MOVABLE TAIL

(71) Applicant: Display Technologies, LLC, Lake Success, NY (US)

(72) Inventors: Bruce Gommermann, Northport, NY (US); Andrew Howard, Mamaroneck, NY (US)

(73) Assignee: Display Technologies, LLC, Lake Success, NY (US)

( * ) Notice: Subject to any disclaimer, the term of this patent is extended or adjusted under 35 U.S.C. 154(b) by 0 days.

(21) Appl. No.: 14/669,315

(22) Filed: Mar. 26, 2015

(65) Prior Publication Data

US 2016/0278540 A1 Sep. 29, 2016

(51) Int. Cl.
*A47F 1/12* (2006.01)

(52) U.S. Cl.
CPC ..... *A47F 1/12* (2013.01)

(58) Field of Classification Search
CPC .. A47F 1/12; A47F 1/123; A47F 1/125; A47F 1/126; A47F 1/128; A47F 5/005; A47F 5/0068; A47F 5/0087; A47F 7/0007; A47F 7/0014
USPC .... 211/41.6, 59.2, 59.3, 90.01, 90.02, 126.1, 211/126.2, 132.1; 108/138
See application file for complete search history.

(56) References Cited

U.S. PATENT DOCUMENTS 2,732,952 A * 1/1956 Skelton ..... A47F 1/126 211/59.3
2,750,049 A * 6/1956 Hunter ..... G07F 11/38 211/59.3
2,789,700 A * 4/1957 King ..... A47F 5/0062 108/32
4,159,831 A 7/1979 Schorr
4,598,828 A * 7/1986 Young ..... A47F 1/12 211/59.2
4,602,570 A 7/1986 Lee
4,620,489 A * 11/1986 Albano ..... A47B 96/025 108/105
4,646,658 A * 3/1987 Lee ..... A47B 96/025 108/137
4,776,472 A 10/1988 Rosen
4,785,943 A * 11/1988 Deffner ..... A47F 5/005 211/128.1
5,050,748 A * 9/1991 Taub ..... A47F 5/0043 211/126.1
5,137,211 A * 8/1992 Summer ..... B65D 5/724 206/353
5,205,421 A 4/1993 Bustos
(Continued)

OTHER PUBLICATIONS

International Search Report PCT/US2016/024469 dated Jun. 20, 2016.

*Primary Examiner* — Joshua Rodden
(74) *Attorney, Agent, or Firm* — Carter, DeLuca, Farrell & Schmidt, LLP

(57) ABSTRACT

A product display unit for use on a shelf. The product display unit includes a bottom member and a tail. The bottom member has a track defining a longitudinal axis. The track is configured to support a plurality of products thereon. The tail is disposed in mechanical cooperation with a distal portion of the track. The tail is movable from a first position where the tail is parallel to the track to a second position where the tail is disposed at an angle with respect to the track.

14 Claims, 4 Drawing Sheets

(56) References Cited

U.S. PATENT DOCUMENTS

| | | | | |
|---|---|---|---|---|
| 5,450,969 | A | 9/1995 | Johnson et al. | |
| 5,715,957 | A | 2/1998 | Merl | |
| 8,490,800 | B2 | 7/2013 | Colin | |
| 2004/0140278 | A1 | 7/2004 | Mueller et al. | |
| 2008/0041279 | A1* | 2/2008 | Johnson | A47B 3/10 108/35 |
| 2012/0080393 | A1* | 4/2012 | Eisman | A47B 43/00 211/86.01 |
| 2012/0118840 | A1 | 5/2012 | Howley | |

* cited by examiner

PRODUCT DISPLAY UNIT WITH MOVABLE TAIL

BACKGROUND

The present disclosure relates to a product display unit, and more particularly, to an inclined product display unit having a movable tail configured to be used to assist in gravity feed of merchandise from various shelving systems.

Various types of product display units and merchandisers are commonly used in retail environments to display different types of products. As opposed to simply positioning products on shelves, product display units are commonly used to position products on a shelf in manner which automatically advances (e.g., via gravity or a pusher) a trailing or distal product (i.e., a product that is behind a lead or proximal-most product) closer to a consumer once the lead product has been removed from the shelf. As can be appreciated, such product display units facilitate the arrangement and upkeep of products, as the trailing products do not have to be manually moved toward the front of the shelf, for instance.

Additionally, in retail environments, for example, floor/shelf space is limited, and retailers typically attempt to maximize the amount of products they can store/display in their retail space.

Accordingly, it is often desirable for retailers to display products in as many viewable and reachable places as possible, while still allowing the products to automatically advance toward the proximal portion of the shelf.

SUMMARY

The present disclosure relates to a product display unit for use on a shelf. The product display unit includes a bottom member and a tail. The bottom member has a track defining a longitudinal axis. The track is configured to support a plurality of products thereon. The tail is disposed in mechanical cooperation with a distal portion of the track. The tail is movable from a first position where the tail is parallel to the track to a second position where the tail is disposed at an angle with respect to the track.

In disclosed embodiments, the tail includes a longitudinal length of between about one inch and about four inches.

It is disclosed that the angle of the tail with respect to the longitudinal axis when the tail is in the second position is between about 10° and about 30°. It is further disclosed that the tail is configured to support at least one product when the tail is in its first position or in its second position.

In disclosed embodiments, the product display unit includes a pair of sidewalls. Each sidewall is disposed adjacent a lateral side of the track. The pair of sidewalls is configured to help maintain products on the track.

It is further disclosed that an entirety of a distal portion of each sidewall of the pair of sidewalls is elevated from the track. It is additionally disclosed that the distal portion of each sidewall of the pair of sidewalls includes a length along the longitudinal axis that is longer than a length of the tail. In disclosed embodiments, a distal-most end of the distal portion of each sidewall of the pair of sidewalls extends farther distally than a distal-most end of the tail.

In disclosed embodiments, the tail is pivotable with respect to the track. It is further disclosed that the tail is connected to the track via a living hinge.

The present disclosure also relates to a method of installing a product display unit on a shelf. The method includes moving a tail of a product display unit from a first position where the tail is parallel to a longitudinal axis defined by a track of the product display unit, to a second position where the tail is disposed at an angle with respect to the longitudinal axis, and positioning the tail on a portion of the shelf.

In disclosed embodiments, the method includes positioning a proximal portion of the product display unit at least partially on the shelf.

It is further disclosed that positioning the tail on a portion of the shelf includes positioning the tail on a wire that is disposed perpendicular to the longitudinal axis.

In disclosed embodiments, when the tail is in its second position, the angle of the tail with respect to the longitudinal axis is between about 10° and about 30°.

It is also disclosed that the method includes positioning a product on the tail.

In disclosed embodiments, moving the tail includes pivoting the tail with respect to the track.

BRIEF DESCRIPTION OF THE DRAWINGS

Embodiments of the present disclosure are described hereinbelow with reference to the drawings wherein.

DETAILED DESCRIPTION

Figure 1:
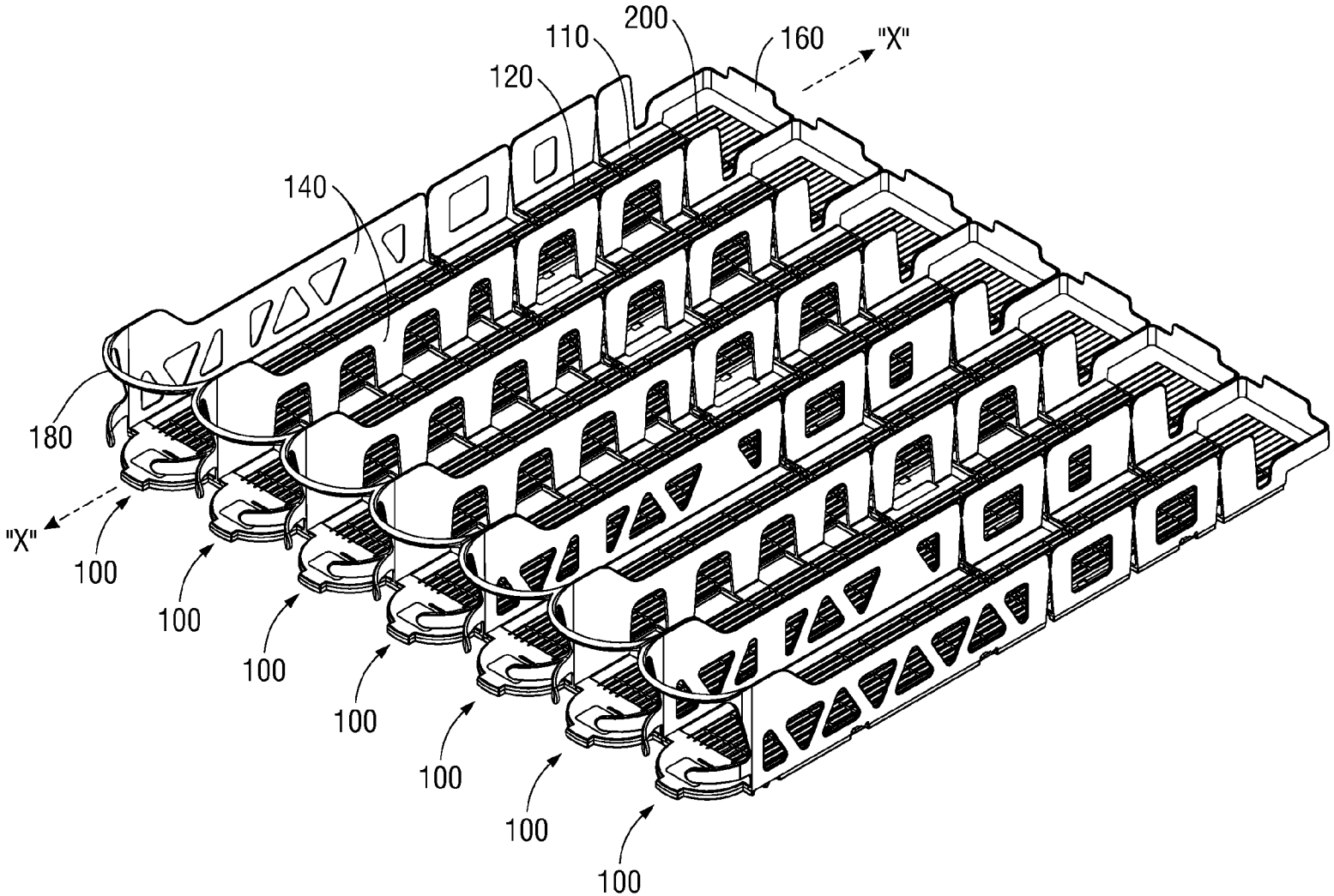
FIG. 1 is a perspective view of a plurality of product display units in accordance with embodiments of the present disclosure.

Embodiments of the presently disclosed product display unit are now described in detail with reference to the drawings, in which like reference numerals designate identical or corresponding elements in each of the several views. As used herein the term "distal" refers to that portion of the product display unit, or component thereof, farther from a user (e.g., customer), while the term "proximal" refers to that portion of the product display unit, or component thereof, closer to the user.

Various embodiments of a product display unit are illustrated in FIGS. 1-5 and are generally referenced by numeral 100. The product display unit 100 includes a bottom member 110 having a track 120, a pair of sidewalls 140, a distal member 160, a proximal member 180, and a tail 200.

Figure 3:
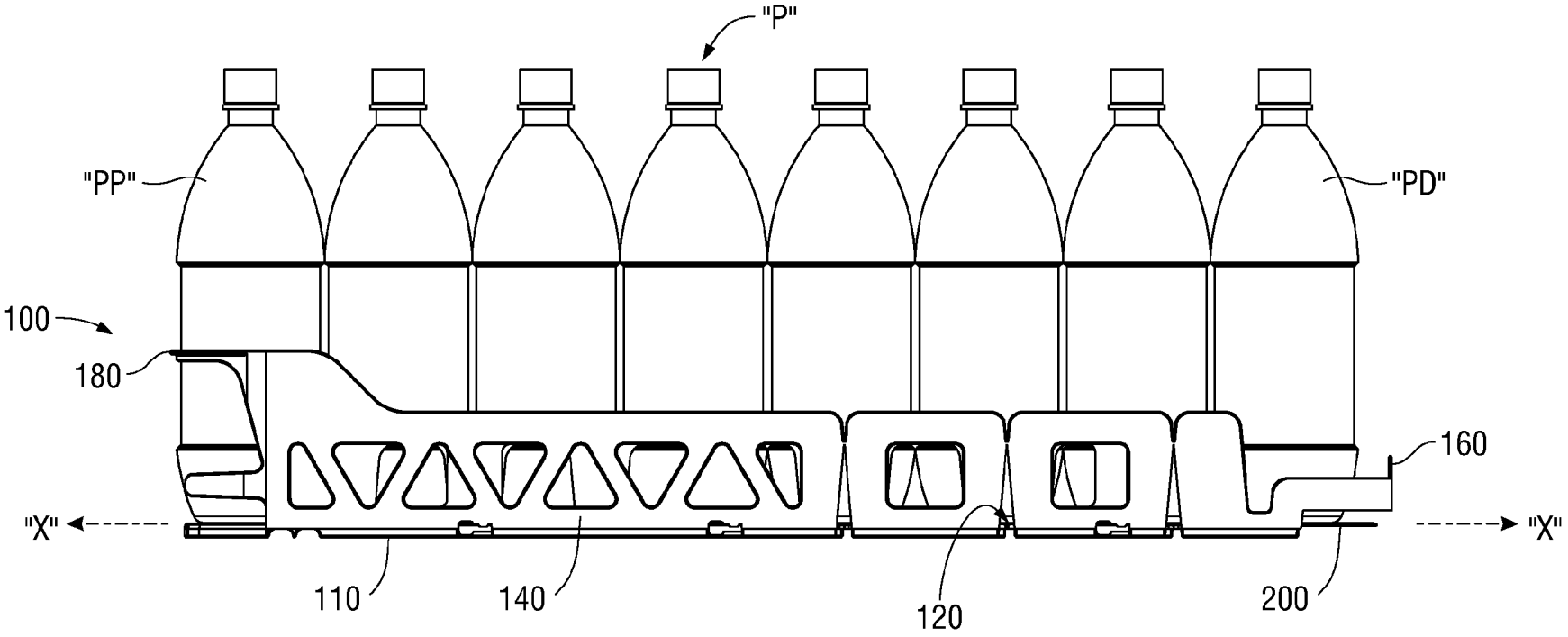
FIG. 3 is a side view of one product display unit of FIGS. 1 and 2 including a plurality of products supported thereon.
Figure 4:
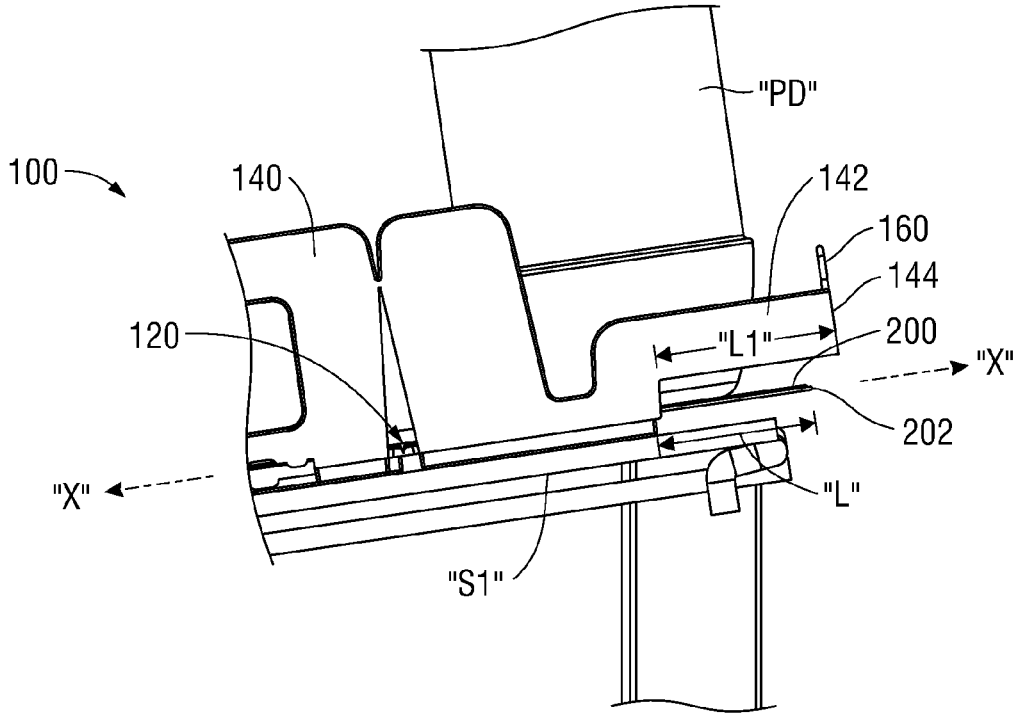
FIG. 4 is a side view of the distal portion of one product display unit of FIGS. 1-3 supported by a first shelf, including a product supported by a tail of the product display unit, and illustrating the tail in a first position.
Figure 5:
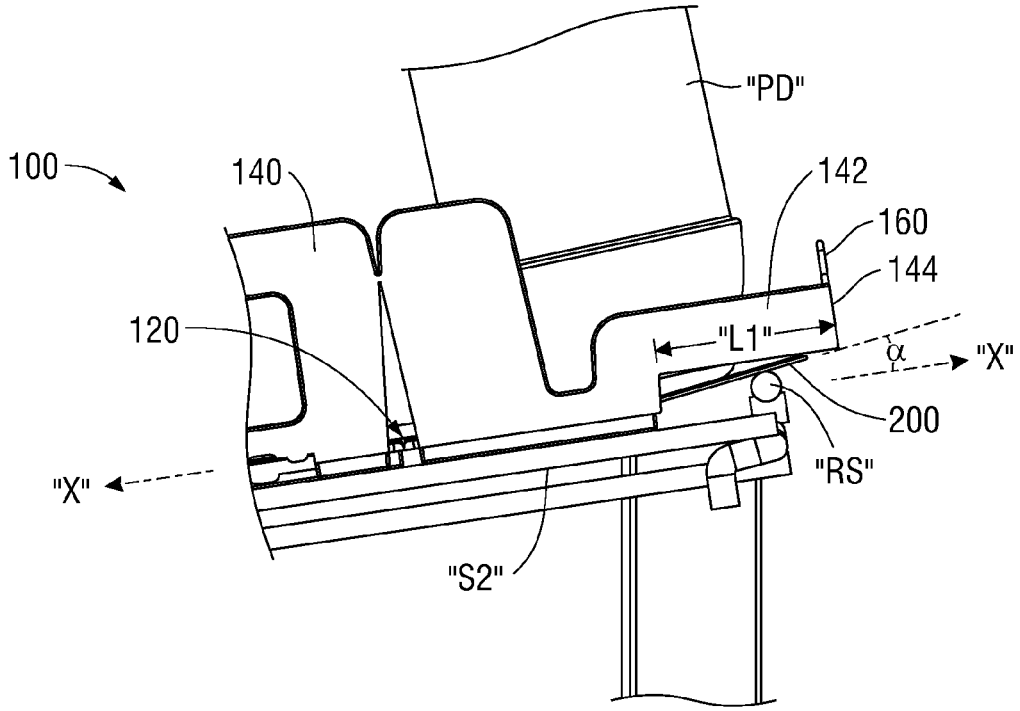
FIG. 5 is a is a side view of the distal portion of one product display unit of FIGS. 1-4 supported by a second shelf, and illustrating the tail in a second position.

The track 120 includes a product-supporting surface and is configured to slidably support a plurality of products "P" thereon (see FIGS. 3-5). That is, products "P" are slidable along the track 120. For example, gravity urges products "P" to slide along the track 120 in a distal-to-proximal direction. In such gravity feed arrangements, a distal portion of the track is elevated with respect to a proximal portion of the track, such that gravity urges the products "P" toward proximal member 180. With particular reference to FIG. 1, the track 120 defines a longitudinal axis "X."

The sidewalls 140 are disposed at both lateral sides of the track 120 and are configured to help maintain products "P" on the track 120. As shown in FIG. 1, for example, when a plurality of product display units 100 is positioned adjacent one another, it is envisioned that adjacent product display units 100 may share a common sidewall 140. Alternatively, each product display unit 100 may include a pair of sidewalls 140 such that, when connected to another product display unit 100, the sidewalls 140 are in an abutting relationship.

The distal member 160 is disposed at the rear or distal portion of the track 120 of the product display unit 100 and is configured to help maintain products "P" on the track 120. More particularly, distal member 160 is configured to help prevent a distal-most product "PD" (FIG. 3) from falling distally off of the track 120 or off of the tail 200.

The proximal member 180 is positioned adjacent the front or proximal portion of the track 120 and is configured to help maintain products "P" on the track 120. More specifically, the proximal member 180 helps prevent a proximal-most product "PP" (FIG. 3) from falling proximally off of the track 120. Additionally, the proximal member 180 opposes the gravitational force and/or the force supplied by a pusher (not shown). Further, while the illustrated embodiments include a certain type of proximal member 180, the present disclosure includes the use of any suitable type and number of proximal members 180 per product display unit 100.

Tail 200 is disposed adjacent a distal end 122 (FIG. 2) of the track 120, and similar to the track 120, the tail 200 is configured to slidably support a product "P" thereon. The tail 200 is pivotable with respect to the track 120 between a first position where the tail 200 is parallel to the longitudinal axis "X" (e.g., FIGS. 3 and 4), to a second position where the tail 200 is disposed at an angle with respect to the longitudinal axis "X" (e.g., FIG. 5). It is envisioned that at least one living hinge 210 interconnects the track 120 and the tail 200. The present disclosure also contemplates other suitable ways of interconnecting the track 120 and the tail 200.

It is envisioned that when the product display unit 100 is used in connection with a shelf "S1" lacking a rear support "RS" or wire (rear support "RS" is illustrated in FIG. 5), as shown in FIG. 4, the tail 200 remains in its first position where the tail 200 is an extension of the track 120 and is parallel to the longitudinal axis "X." Here, the tail 200 is configured to support the distal-most product "PD."

It is further envisioned that when the product display unit 100 is used in connection with a shelf "S2" including a rear support "RS" or wire, as shown in FIG. 5, the tail 200 pivots to its second position, where the tail 200 is at an angle with respect to the longitudinal axis "X." Here, the tail 200 rests on and is supported by the rear support "RS," and the tail 200 is configured to support the distal-most product "PD." By contrast, when a product display unit lacking the presently-disclosed tail 200 is used in connection with a shelf "S2" including a rear support "RS," various components (e.g., sidewalls, track, etc.) of such a product display unit may bend, warp, etc., over time because of the additional stresses applied to the product display unit as a result of its engagement with the rear support "RS," for instance.

With particular reference to FIG. 5 where the tail 200 is in its second position, the tail 200 is disposed at an angle $\alpha$ with respect to the longitudinal axis "X." It is envisioned that when the tail 200 is in the second position, the angle $\alpha$ is between about 5° and about 15°.

Figure 2:
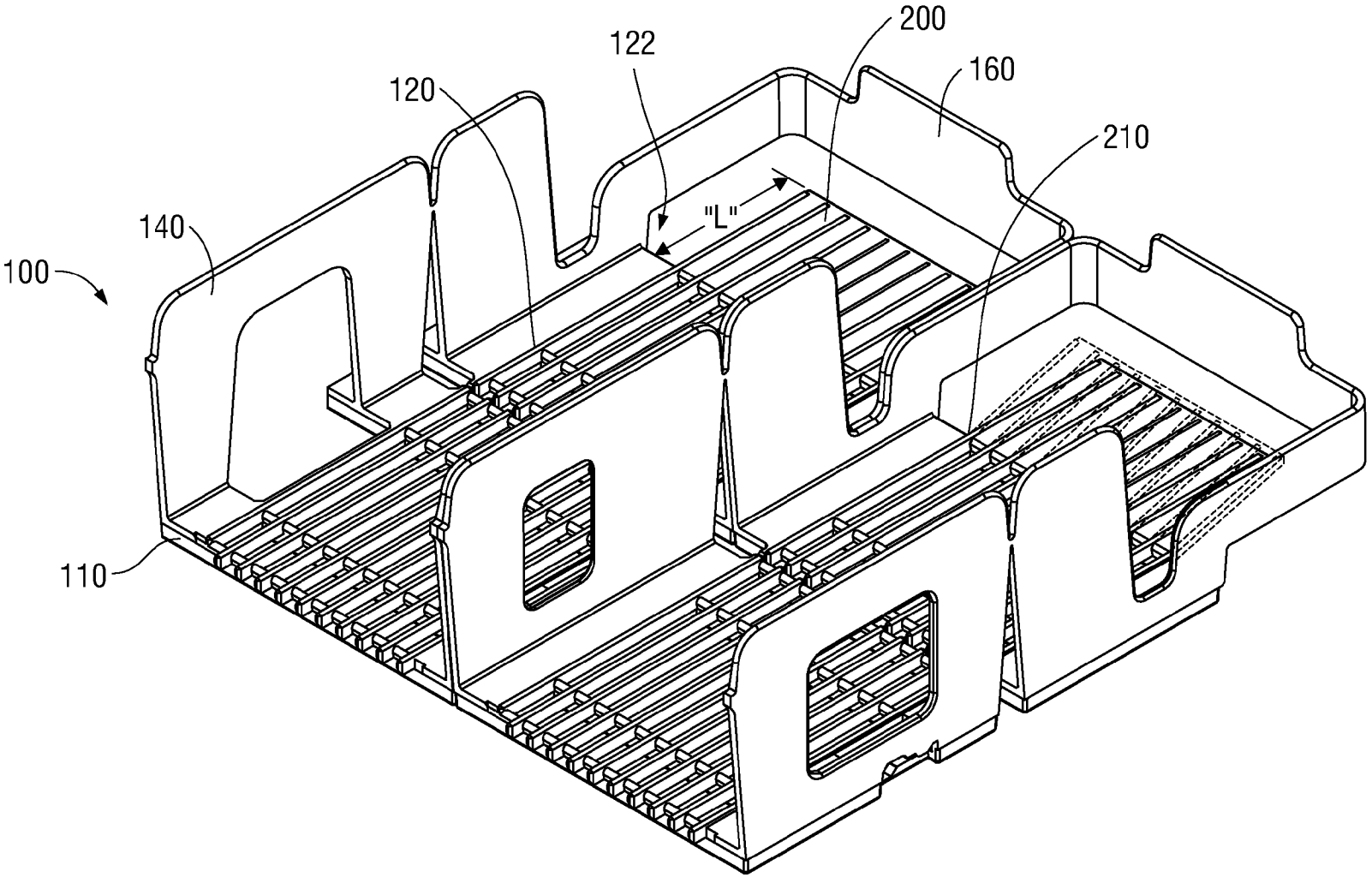
FIG. 2 is a perspective view of a distal portion of two product display units of FIG. 1.

It is further envisioned that a length "L" of the tail 200 is between about one inch and about four inches (see FIG. 2). In disclosed embodiments, the length "L" of the tail is equal to about 1.75 inches.

With particular reference to FIGS. 4 and 5, a distal portion 142 of the sidewall 140 is illustrated. The distal portion 142 of the sidewall 140 is defined as the distal part of the sidewall 140 that is elevated from the track 120 and/or tail 200. Thus, an entirety of the distal portion 142 of the sidewall 140 (e.g., each sidewall 140) is spaced from or elevated with respect to the track 120 and tail 200. As can be appreciated with reference to FIG. 5, the elevated distal portion 142 of the sidewall 140 prevents the sidewall 140 from contacting the rear support "RS" of the shelf "S2."

As shown in FIGS. 4 and 5, a length "L1" of the distal portion 142 of the sidewalls 140 is longer than the length "L" of the tail 200. As further illustrated, a distal-most end 144 of the distal portion 142 of the sidewalls 140 extends farther distally than a distal-most end 202 of the tail 200. Additionally, the distal member 160 is disposed farther distally than the distal-most end 202 of the tail 200.

The present disclosure also includes methods of installing the product display unit 100 on a shelf, e.g., "S2." Disclosed methods include moving the tail 200 from its first position where the tail 200 is parallel to the longitudinal axis "X" defined by the track 120, to its second position where the tail 200 is disposed at an angle with respect to the longitudinal axis "X," and positioning the tail 200 on a portion (e.g., the rear support "RS") of the shelf "S2." Disclosed aspects of the method include positioning a proximal portion 102 of the product display unit 100 at least partially on the shelf "S2."

In disclosed embodiments, positioning the tail 200 on a portion of the shelf "S2" includes positioning the tail 200 on a wire or rear support "RS" that is disposed perpendicular to the longitudinal axis "X." Further aspects of disclosed methods include angulating the tail 200 with respect to the longitudinal axis "X" such that the angle $\alpha$ is between about 10° and about 30°, and positioning a product "P" on the tail 200. Additionally, it is disclosed that moving the tail 200 includes pivoting the tail 200. It is further disclosed that the tail 200 is automatically pivoted (e.g., without human intervention) upon contacting the rear support "RS," such that the tail 200 automatically moves towards or into its second position during installation of the product display unit 100 onto the shelf "S2."

Further, while the accompanying figures illustrate a particular number of product display units 100 disposed adjacent each other, it is envisioned and within the scope of the present disclosure to include more or fewer amounts of product display units 100, and to include product display units 100 of other sizes, and disposed at different angles than those illustrated, for example. Additionally, the present disclosure contemplates the use of a pusher assembly to urge products "P" proximally on the track 120 (e.g., when the slope of the shelf "S1" or "S2" is insufficient to urge the products "P" proximally via gravity).

Further details of related product display units are described in commonly-owned U.S. Pat. No. 5,645,176, which issued on Jul. 8, 1997, the entire contents of which being incorporated by reference herein.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended hereto.

The invention claimed is:

1. A product display unit for use on a shelf, the product display unit comprising:

a bottom member having a track defining a longitudinal axis, the track configured to support a plurality of products thereon;

a pair of sidewalls, each sidewall includes a fixed longitudinal length and is disposed adjacent a lateral side of the track, the pair of sidewalls configured to help maintain the plurality products on the track, an entirety of a distal portion of each sidewall of the pair of sidewalls is elevated from the track;

a tail disposed in mechanical cooperation with a distal portion of the track, the tail being movable from a first position where the tail is parallel to the track to a second position where the tail is disposed at an angle with respect to the track;

wherein the product display unit includes a length defined between a proximal-most end thereof and a distal-most end thereof, wherein the length of the product display unit is the same when the tail is in the first position and when the tail is in the second position.

2. The product display unit according to claim 1, wherein the tail includes a longitudinal length of between about one inch and about four inches.

3. The product display unit according to claim 1, wherein the angle of the tail with respect to the longitudinal axis when the tail is in the second position is between about 10° and about 30°.

4. The product display unit according to claim 1, wherein the tail is configured to support at least one product of the plurality of products when the tail is in its first position.

5. The product display unit according to claim 4, wherein the tail is configured to support the at least one product of the plurality of products when the tail is in its second position.

6. The product display unit according to claim 1, wherein the distal portion of each sidewall of the pair of sidewalls includes a length along the longitudinal axis that is longer than a length of the tail.

7. The product display unit according to claim 1, wherein a distal-most end of the distal portion of each sidewall of the pair of sidewalls extends farther distally than a distal-most end of the tail.

8. The product display unit according to claim 1, wherein the tail is pivotable with respect to the track.

9. The product display unit according to claim 1, wherein the tail is connected to the track via a living hinge.

10. A method of installing a product display unit on a shelf, comprising:

moving a tail of the product display unit from a first position where the tail is parallel to a longitudinal axis defined by a track of the product display unit, to a second position where the tail is disposed at an angle with respect to the longitudinal axis; and positioning the tail on a portion of the shelf including positioning the tail on a wire that is disposed perpendicular to the longitudinal axis;

wherein the product display unit includes a fixed length defined between a proximal-most end thereof and a distal-most end thereof.

11. The method according to claim 10, further comprising positioning a proximal portion of the product display unit at least partially on the shelf.

12. The method according to claim 10, wherein when the tail is in its second position, the angle of the tail with respect to the longitudinal axis is between about 10° and about 30°.

13. The method according to claim 10, further comprising positioning a product on the tail.

14. The method according to claim 10, wherein moving the tail includes pivoting the tail with respect to the track.

* * * * *